United States Patent [19]

Egami et al.

[11] Patent Number: 4,635,200

[45] Date of Patent: Jan. 6, 1987

[54] SYSTEM FOR CONTROLLING AIR-FUEL RATIO IN AN INTERNAL COMBUSTION ENGINE

[75] Inventors: Tsuneyuki Egami, Aichi; Tsutomu Saito, Okazaki; Tokio Kohama, Nishio; Kimitaka Saito; Kunihiko Sato, both of Okazaki; Hiroshi Takahashi, Toyota, all of Japan

[73] Assignees: Nippon Soken, Inc., Nishio; Toyota Jidosha Kabushiki Kaisha, Toyota, both of Japan

[21] Appl. No.: 619,210

[22] Filed: Jun. 11, 1984

[30] Foreign Application Priority Data

Jun. 16, 1983 [JP] Japan ..... 58-106697
Jul. 26, 1983 [JP] Japan ..... 58-135260

[51] Int. Cl.[4] ..... F02B 3/00

[52] U.S. Cl. ..... 364/431.05; 123/480; 123/492; 364/431.07

[58] Field of Search ..... 364/431.05, 431.07; 123/492, 493, 480

[56] References Cited

U.S. PATENT DOCUMENTS 4,130,095 12/1978 Bowler et al. .
4,235,204 11/1980 Rice ..... 364/431.05
4,270,503 6/1981 Pomerantz .
4,322,800 3/1982 Hisegawa et al. ..... 364/431.05
4,469,074 9/1984 Takao et al. ..... 123/480
4,481,928 11/1984 Takimoto et al. ..... 123/492

FOREIGN PATENT DOCUMENTS 58-133435 8/1983 Japan .
58-133434 8/1983 Japan .

*Primary Examiner*—Parshotam S. Lall
*Attorney, Agent, or Firm*—Cushman, Darby & Cushman

[57] ABSTRACT

A system for controlling the air-fuel ratio in an internal combustion engine provided with a fuel injector. The system has an $O_2$ sensor for issuing signals on two levels, one corresponding to a high air-fuel ratio, the other to a low air-fuel ratio, and a feedback control device responsive to the signal from the sensor. The feedback control calculates a correction factor for maintaining the air-fuel ratio to a desired value during steady operation and for indicating the deviation in the ratio from the desired value during transient conditions. This deviation is employed to generate a transient correction value which is selected to minimize the deviation during transient conditions.

3 Claims, 32 Drawing Figures

Fig. 14 (a)
Fig. 14 (b)
Fig. 14 (c)
Fig. 14 (d)
Fig. 14 (e)
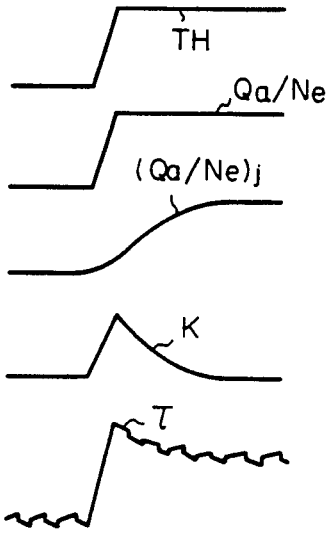
Fig. 15 (a)
Fig. 15 (b)
Fig. 15 (c)
Fig. 15 (d)
Fig. 15 (e)
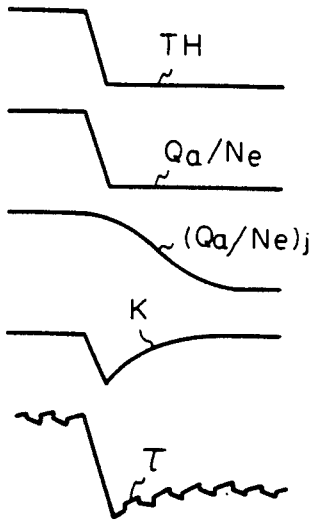

SYSTEM FOR CONTROLLING AIR-FUEL RATIO IN AN INTERNAL COMBUSTION ENGINE

BACKGROUND OF THE INVENTION

1. Field of the Invention

The present invention relates to a system for controlling the air-fuel ratio in an internal combustion engine provided with fuel injectors, the system being operated by a feedback control to maintain a constant air-fuel ratio under various engine operating conditions.

2. Description of the Prior Art

Japanese Unexamined Patent Publication (Kokai) No. 56-6034 discloses an air-fuel ratio control system for an internal combustion engine in which a basic fuel-requirement signal is generated in response to certain engine operating parameters, including engine temperature, which indicate the fuel requirements of the engine while running in a stable condition. This prior art also discloses a means for detecting the operating condition of the engine during a transient state and indicating a required increase in an engine output, and means for generating a signal for intensifying the air-fuel ratio correction in accordance with the sensed engine temperature and the sensed operating condition of the engine during the transient state. This air-fuel ratio correction signal has an initial value determined by the engine temperature and the sensed engine transient state, and this value is increased toward 1.0 at a speed determined by the temperature of the engine. The prior art also includes a means for supplying fuel to the engine in accordance with the above-mentioned basic signal and the intensifying air-fuel ratio correction signal, so that a required amount of fuel is supplied to the engine at both the stable running condition and the transient state. This system can maintain an optimum or predetermined air-fuel ratio not only in the stable running condition but also in the transient state of the engine, thus obtaining an optimum engine operation.

A disadvantage of this prior art system is that it is not provided with a means for compensating the changes in the characteristics of the engine which occur after the engine has been in operation for a prolonged period, such as oil or carbon deposits in the valve clearance, in the injector nozzle, or at the back of the intake valve. These deposits originate mainly from oil or carbon residues caused by combustion. The characteristics of an engine also change when different blends of gasoline are used. Thus, a system having no means of compensating for such changes in characteristics is disadvantaged in that the air-fuel mixture will often become lean during acceleration, causing a rough acceleration and an inferior drivability, when an inferior blend of gasoline is used or when the engine characteristics are changed after a prolonged period of operation. Also, when the correct blend of gasoline is used, the fuel consumption efficiency is decreased, or the amount of toxic emissions is increased, by a rich air-fuel mixture during acceleration.

An attempt was made to solve this problem in the prior art by controlling the correction factor during acceleration or deceleration in accordance with the engine warm-up condition. However, this was insufficient to cope with the above-mentioned changes in the air-fuel ratio caused by the changes in the engine characteristics, such as carbon or oil deposits on the valve plate of the intake pipe or an incorrect blend of gasoline.

SUMMARY OF THE INVENTION

An object of the present engine is to provide a system capable of overcoming the above-mentioned difficulties encountered in the prior art.

Another object of the present invention is to provide a system capable of maintaining a constant air-fuel ratio despite changes in the engine operating conditions caused by oil or carbon deposits, by prolonged use, by different blends of gasoline, or by other factors stemming from differences in tolerances in individual mass-produced engines and components such as an air-flow meter.

A further object of the present invention is to provide a system capable of maintaining the best possible fuel consumption-efficiency and automobile drivability.

BRIEF DESCRIPTION OF THE DRAWINGS

FIGS. 14(*a*)–14(*e*) and 15(*a*)–15(*e*) show changes of various factors shown in FIGS. 12*a*, 12*b*, and 13;

DESCRIPTION OF THE PREFERRED EMBODIMENTS

Figure 1:
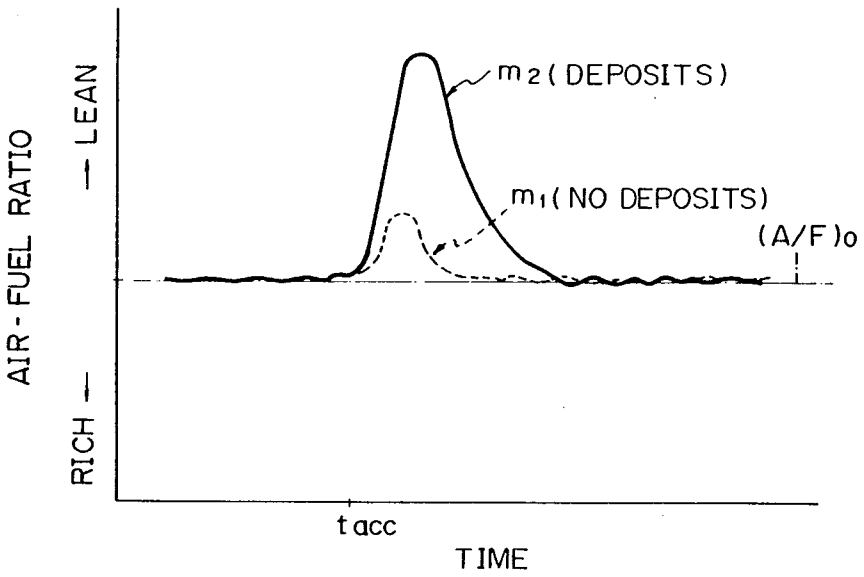
FIG. 1 shows the difference in the air-fuel ratio caused when deposits exist and when deposits do not exist.

In FIG. 1, the air-fuel ratio change in the prior art is illustrated in accordance with the lapse of time wherein an acceleration is effected at the time $t_{acc}$. A certain off-set or deviation of the air-fuel ratio from a target air-fuel ratio value $(A/F)_0$, which may be equal to the stoichiometric air-fuel ratio, is caused at acceleration. Where there are no deposits in the engine, the air-fuel ratio changes as shown by curve $m_1$. When deposits have occurred, the air-fuel ratio changes as shown by curve $m_2$. It will be clear from the figure that, in the prior art, a large offset of the air-fuel ratio occurs during acceleration when the engine contains deposits.

The deviation of an air-fuel ratio during acceleration also occurs when the injector is clogged, because there is no way of compensating for the change in air-fuel ratio during acceleration, despite the fact that the air-fuel ratio deviation from the target value during the stable running condition of the engine is automatically corrected by the feedback mechanism. The above deviation is also caused by differences in tolerances in individual mass-produced engines or components such as air-flow meters, or by changes in the engine characteristics stemming from prolonged use.

Figure 2:
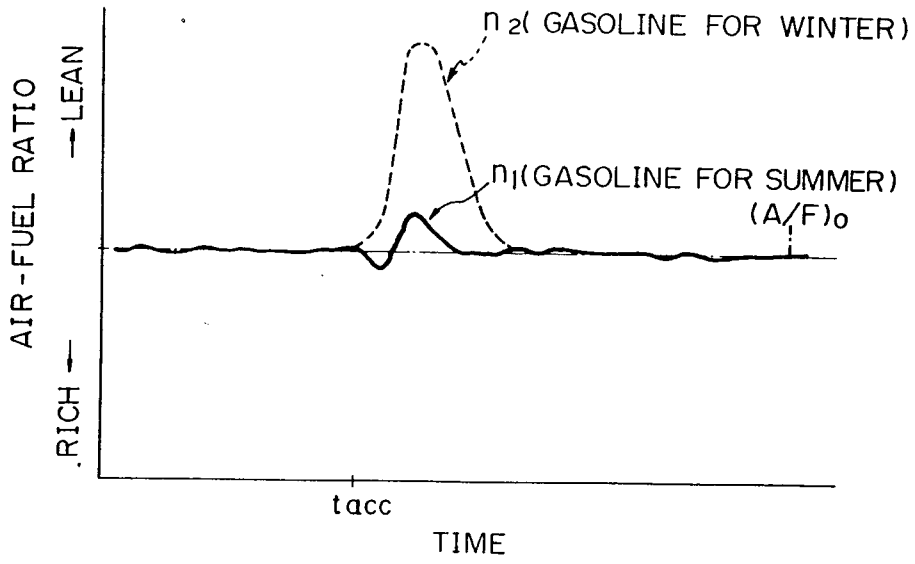
FIG. 2 shows the difference in the air-fuel ratio when the engine is operating on gasoline blended for summer use and for winter use.

FIG. 2 shows the changes in the air-fuel ratio caused by using different blends of gasoline. This problem is brought about by factors similar to those previously mentioned regarding production differences, and by changes in the gasoline blends produced for summer and winter operation, i.e., different blends of gasoline have different volatilities. The volatility of a gasoline blend is evaluated by its Reid vapor pressure or distillation property values. Gasoline produced by a certain maker can have a Reid vapor pressure value of between 0.5 kg/cm$^2$ to 0.86 kg/cm$^2$, and a distillation temperature differing by 10%, e.g., between 40° C. to 50° C., depending on the season of the year. These differences in the gasoline cause the changes in the air-fuel ratio as shown in FIG. 2. In FIG. 2, curve $n_1$ shows the air-fuel ratio needed for a gasoline blended for summer use, and curve $n_2$ shows that needed for a gasoline blended for winter use. In FIG. 2, although the air-fuel ratio is shown as deviating toward the lean side, the air-fuel ratio may also deviate toward the rich side.

The present invention will now be described with reference to the attached drawings.

Figure 3:
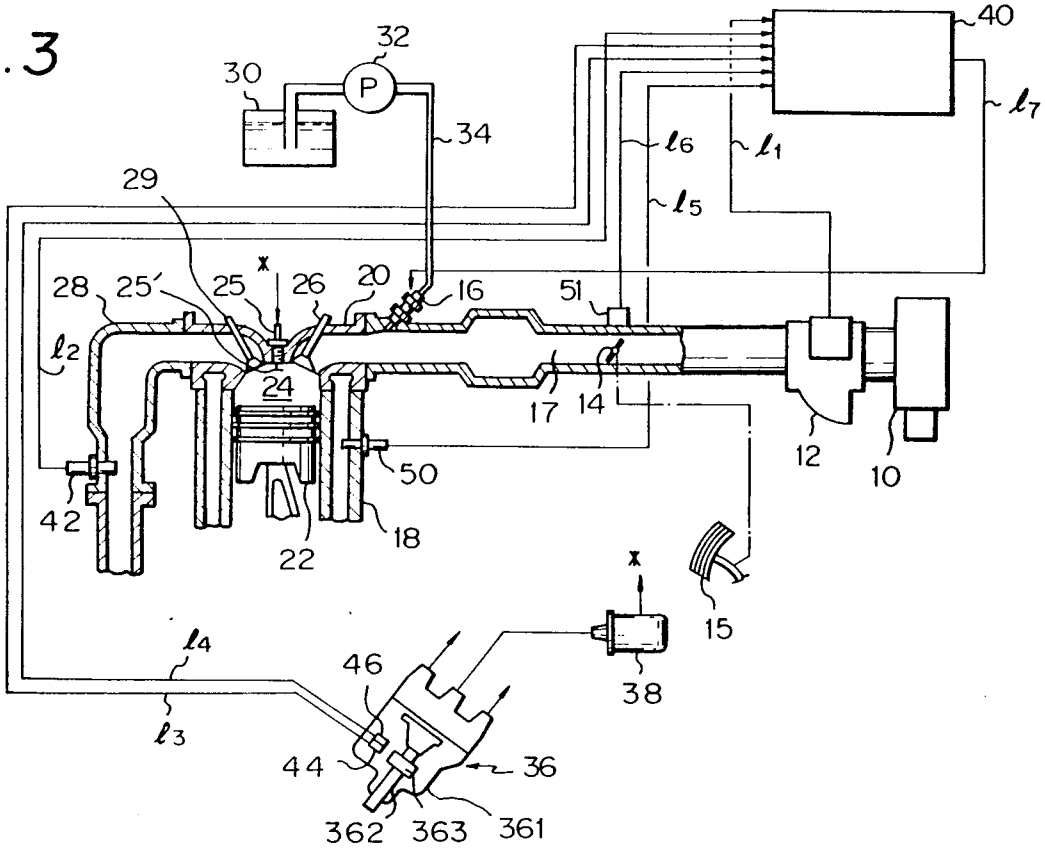
FIG. 3 shows an embodiment of the system of the present invention.

FIG. 3 shows an internal combustion engine having an air cleaner 10. Downstream of the air cleaner 10, an air-flow meter 12 and a throttle valve 14 are arranged in an intake pipe 17 of the engine. A fuel injection nozzle 16 is opened to the intake pipe 17 at a position near to an engine body. The engine body has a cylinder block 18 and a cylinder head 20 fixed to the cylinder block 18. A piston 22 is arranged in the cylinder block 18, with a combustion chamber 24 formed above the piston 22. A spark plug 25 is mounted to the cylinder head 20 so that a spark gap 25' of the spark plug 25 is opened to the combustion chamber 24. The combustion chamber 24 is connected to the intake pipe 17 by way of an intake valve 26, so that a combustible mixture from the intake pipe 17 is introduced into the combustion chamber 24 when the intake valve 26 is opened. The combustion chamber 24 is also connected to an exhaust manifold 28 via an exhaust valve 29, so that the resultant exhaust gas is forced out of the combustion chamber 24 and into the exhaust manifold 28 when the exhaust valve 29 is opened. A fuel tank 30 is connected to the fuel injector 16 via a fuel pump 32 and a fuel delivery pipe 34. The engine is further provided with an ignition system having a distributor 36 and an ignition coil 38, which system is connected to the spark plug 25.

According to the present invention, a control circuit 40 controls the fuel injection. Sensors are connected to the control circuit 40 to detect the various engine operating conditions. The air-flow meter 12 produces a signal indicating the amount of air introduced into the engine, which signal is input to the control circuit 40 via a line $l_1$. An $O_2$ sensor 42 provided on the exhaust manifold 28 produces a signal indicating the air-fuel ratio, which signal is input to the control circuit 40 via a line $l_2$. A pair of crank signal sensors 44 and 46 are mounted on a casing 361 of the distributer 36 in such a manner that they face a detecting piece 363 mounted on a distributor shaft 362 of the distributor 36. One of the sensors 44 detects the rotational speed of the engine, and produces a plurality of pulses during every one rotation of the engine which are input to the control circuit 40 via a line $l_3$. The other sensor 46 detects a predetermined position of the piston 22 of a predetermined one cylinder of the engine, and produces a pulse at every one rotation of the engine, which pulse is input to the control circuit 40 via a line $l_4$. A temperature sensor 50 is mounted to the cylinder block 18 in such a manner that it is in contact with a cooling water in the cylinder block 18, to produce a signal indicating the temperature of the cooling water, which signal is input to the control circuit 40 via a line $l_5$. A throttle sensor 51 is connected to the throttle valve 14, to produce a signal indicating the opening of the throttle valve 14, which signal is input to the control circuit 40 via a line $l_6$.

As will be described more fully later, the control circuit 40 calculates the amount of fuel to be injected by processing the signals from the above-mentioned sensors, and produces a signal which is input to the fuel injector 16 via a line $l_7$, thus operating the injector 16.

Figure 4A:
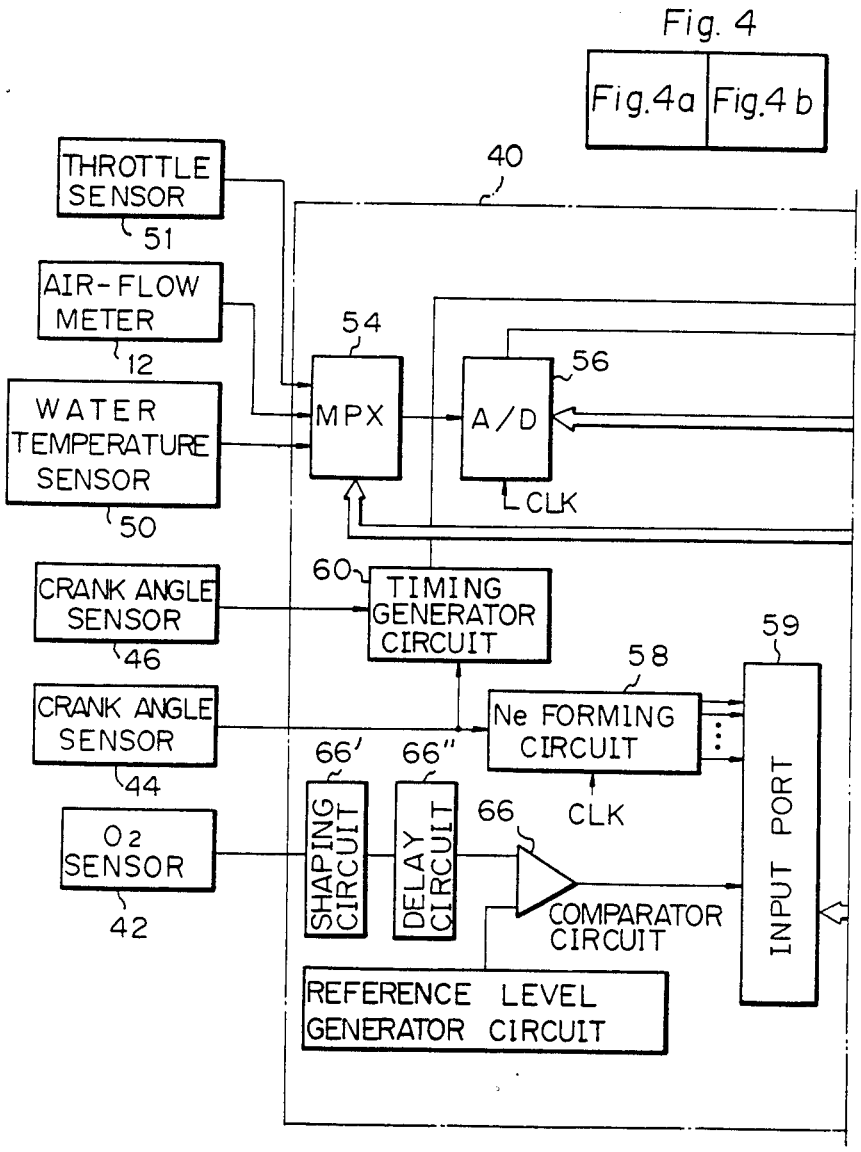
FIGS. 4*a* and 4*b* are a block diagram of the control circuit shown in FIG. 4.
Figure 4B:
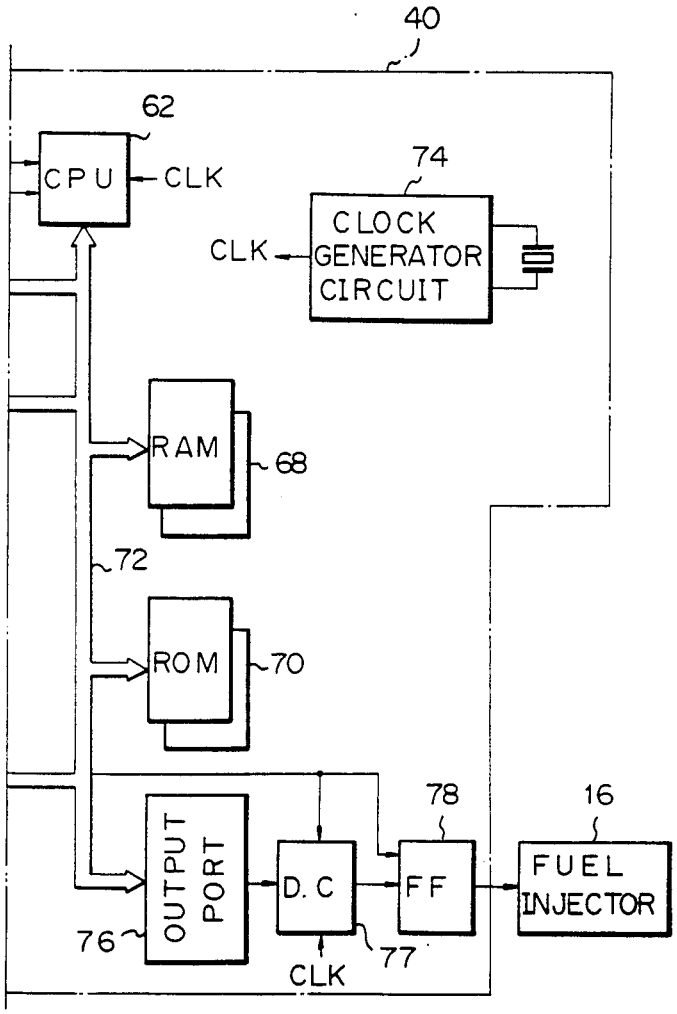

The control circuit 40 is constructed as shown in FIGS. 4*a* and 4*b*. As shown in the figures, control circuit 40 has an analog multiplexer 54, to which the air-flow meter 12, the water temperature sensor 50, and the throttle sensor 51 are connected together with other analog type sensors (not shown) not directly related with the present invention. The analog multiplexer 54 is connected to an analog-to-digital (A/D) converter 56, wherein the analog signals are changed to digital signals. The crank angle sensor 44, which produces a plurality of pulses per one engine rotation, is connected to a velocity-signal-forming circuit 58, which is a counter circuit for counting the number of pulses from the sensor 44. The velocity-signal-forming circuit 58 is connected to an input port 59. This sensor 44 is also connected to a timing generator circuit 60 together with the crank angle sensor 46, for producing a single pulse per every one rotation of the engine. The timing generator circuit 60 is connected to a central processing unit (CPU) 62 for permitting an interruption to start. The $O_2$ sensor 42 is connected to a comparator circuit 66 at one input. A reference level generator circuit 67 is connected to the other input of the comparator circuit 66. The output of the comparator circuit 66 is connected to the input port 59. The comparator circuit 66 has a shaping circuit 66' and a delay circuit 66'' connected between its input and the $O_2$ sensor.

The analog multiplexer 54, the A/D converter 56, and the input port 56 are connected, via a bus 72, to the CPU 62, a read only memory (ROM) 70, and a random access memory (RAM) 68, which are constitutional elements of a microcomputer system. The CPU 62 operates, in response to a clock signal generator 74, to receive signals from the sensors and to calculate the amount of fuel to be injected. The bus 72 is connected to an output port 76 for receiving the calculated result from the CPU 62. The output port 76 is connected to the fuel injector 16 via a down counter 77 and a bistable circuit 78.

Figure 5:
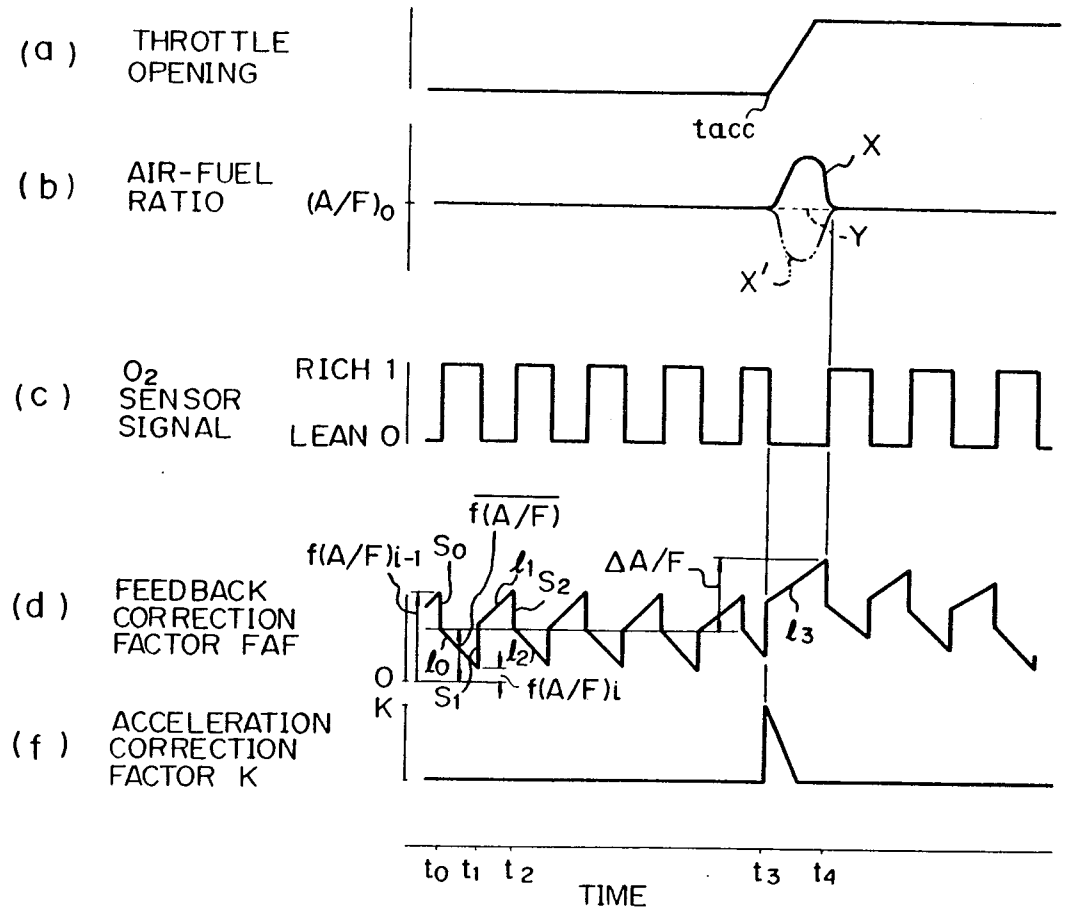
FIGS. 5(*a*), (*b*), (*c*), (*d*), (*f*) are timing charts concerning the various engine operating factors.

FIG. 5 is a timing chart showing various factors of the operation of the system according to the present invention.

The CPU 62 calculates, as will be fully described later, an amount of fuel to be injected. This amount is determined when the engine is in a stable running condition by the product of the basic fuel amount $t_p$ (corresponding to the time from the opening of the injector 16 to the closing of the injector 16) and a feedback correction factor FAF.

The $O_2$ sensor outputs an electric signal corresponding to the air-fuel ratio; i.e., the output voltage level is alternately made high or low in accordance with the air-fuel ratio value. The high level voltage corresponds to an air-fuel ratio value which is smaller than the stoichiometric air-fuel ratio, i.e., a rich air-fuel mixture. The low level voltage corresponds to an air-fuel ratio value which is larger than the stoichiometric ratio, i.e., a lean air-fuel mixture. The comparator circuit 66 then compares the signal from the $O_2$ sensor with a fixed reference level. When the signal level is higher than the fixed level, the comparator 66 issues a logic signal "1", indicating that the air-fuel mixture is rich. When the signal level is lower than the fixed value, the comparator 66 issues a logic signal "0", indicating that the air-fuel mixture is lean. Thus, a signal is obtained with a value which alternately changes between "0" and "1" in accordance with the air-fuel ratio value, as shown in FIG. 5(*c*).

Assuming that, at time $t_o$ in FIG. 5(*d*), the condition at the $O_2$ sensor 42 changes from a "0" signal to a "1" signal, because the $O_2$ sensor 42 has detected an air-fuel ratio value smaller than the stoichiometric air-fuel ratio, i.e., a rich air-fuel mixture, and therefore an amount of fuel to be injected from the fuel injector 16 is to be decreased. To decrease the amount of fuel to be injected, the feedback correction factor FAF to be multiplied with the basic fuel amount $t_p$ to be injected is decreased, as shown by a line $l_0$ in FIG. 5(*d*). Because of the decrease in the correction factor FAF, the amount of fuel to be injected is also decreased, so that the air-fuel ratio value is increased toward the stoichiometric air-fuel ratio.

As shown in FIG. 5(*c*), at time $t_1$ the condition at the $O_2$ sensor 42 changes from a "1" signal to a "0" signal, because the $O_2$ sensor 42 now detects an air-fuel ratio value higher than the stoichiometric air-fuel ratio, i.e., a lean air-fuel mixture, and an amount of fuel to be injected is then to be increased. To increase the amount of fuel to be injected, the feedback correction factor FAF is now increased, as shown by a line $l_1$ in FIG. 5(*d*). Because of the increase in the correction factor FAF, the amount of fuel to be injected is also increased, so that the air-fuel ratio value is decreased toward the stoichiometric ratio $(A/F)_0$.

At the time $t_2$, the condition at the $O_2$ sensor 42 again changes from "0" to "1", because the $O_2$ sensor 42 detects an air-fuel ratio lower than the predetermined air-fuel ratio value $(A/F)_0$. The correction factor FAF is then decreased, as shown by a line $l_2$.

At the time $t_0$, $t_1$, or $t_2$, when the condition at the $O_2$ sensor 42 changes from "1" to "0" or "0" to "1", an abrupt change of the feedback correction factor FAF, known as a "skip", is attained, as shown by a line $S_0$, $S_1$, or $S_2$ in FIG. 5(*d*). As is well known to those skilled in the art, such a skip control allows the air-fuel ratio to be quickly controlled to the target value $(A/F)_0$, as shown in FIG. 5(*b*).

The engine operation changes from the stable condition to an acceleration condition at a time $t_3$ (see FIG. 5(*a*)). In this acceleration condition, the engine requires an increased amount of fuel to be injected. The feedback control is not sufficient to quickly respond to the fuel requirement, and an acceleration correction factor to be multiplied is therefore employed to increase the amount of fuel to be injected, and thus maintain a constant air-fuel ratio during the acceleration. However, introduction of the acceleration correction factor alone is not sufficient to fully correct the air-fuel ratio during the acceleration to the target value $(A/F)_0$, based on the various factors occurring while the engine is in the transient state; which includes oil or carbon deposits or different blends of gasoline, as already mentioned. Therefore, the air-fuel ratio value during acceleration may move away from the target value and toward the lean side, as shown by a line X in FIG. 5(*b*), which phenomenon is known as a "lean spike", or toward the rich side, as shown by X', which is known as a "rich spike".

The present invention is intended to prevent such deviation of the air-fuel ratio from occurring, by the following principles.

According to the present invention, when there is a deviation of the air-fuel ratio from the target value, such as that shown by the line X or X' in FIG. 5(*b*), the feedback correction factor FAF should have a value which differs from a value obtained during the stable running condition. This attains a difference of $\Delta A/F$ over the average $\bar{f}(\overline{A/F})$ of the feedback correction factor during the stable condition. This difference is taken as a measurement of the deviation of the air-fuel ratio to the target air-fuel ratio value $(A/F)_0$, caused by the transient condition of the engine. This means that control of the acceleration correction factor K obtained in accordance with the change of the air-fuel ratio $\Delta F/A$ permits the system to effect a "learning control" in such a manner that the deviation of the air-fuel ratio from the target value is gradually decreased as the engine experiences the subsequent series of accelerations. In this way, the air-fuel ratio is finally maintained at the target value, as shown by a line Y in FIG. 5(*b*), during the acceleration.

The software routines designed for attaining the above-mentioned operation for controlling the air fuel ratio at the stable running condition as well as the transient condition will now be fully described with reference to the drawings.

Figure 6:
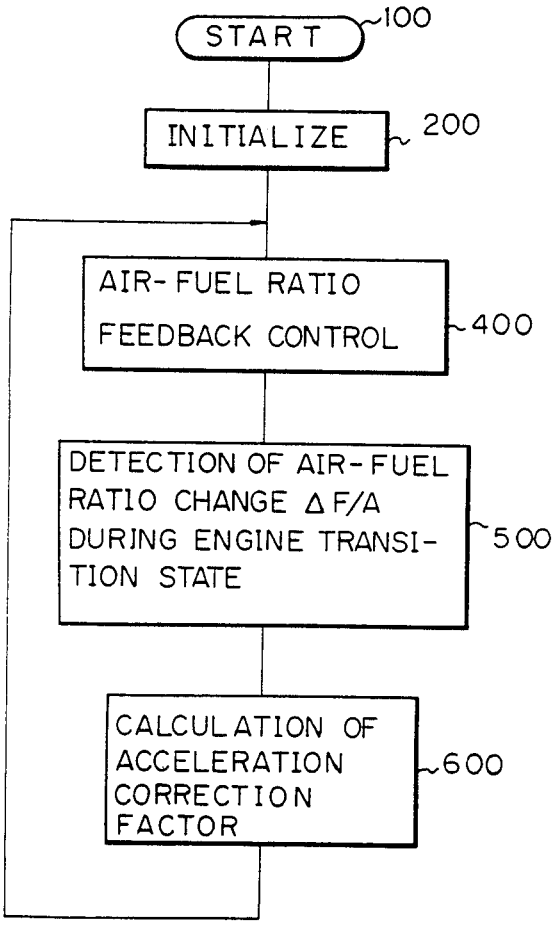
FIG. 6 is a flow chart of a main routine stored as a program in the computer.

FIG. 6 illustrates the main routine effected by the control circuit 40. At a point 100, the computer enters a calculation routine. It then proceeds to point 200, where an initialize operation is effected to clear or set the registers in the CPU 62, the RAM 68, and the input and output ports 59 and 76. At the next point 400, a feedback control of the fuel injection operation is effected so that the air-fuel ratio is controlled to the target value, i.e., stoichiometric air-fuel ratio. At point 500, a deviation or offset of the air-fuel ratio value at the time the engine enters into a transient state from the stable running condition is detected. At the next point 600, an acceleration correction factor K is calculated. The program then proceeds to point 400 and is ready to repeat the above-mentioned procedures.

Figure 7:
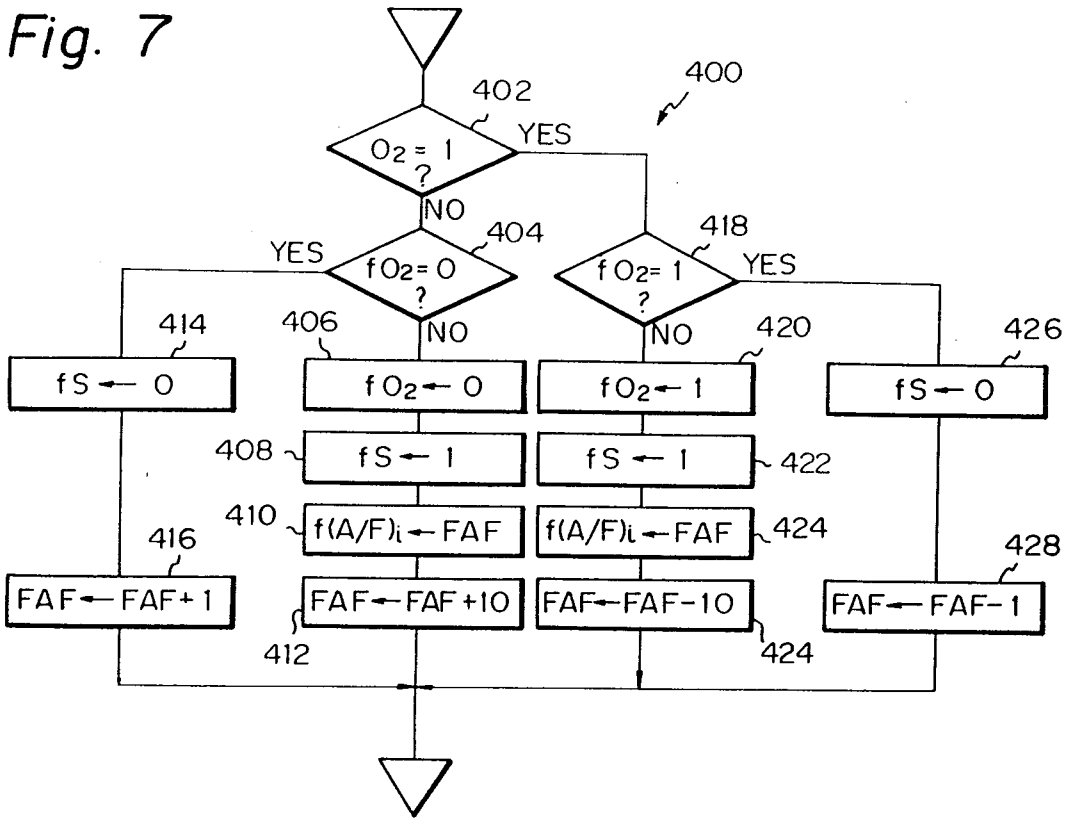
FIG. 7 is a flow chart showing details of the feedback control routine shown in FIG. 6.

The feedback control routine 400 is shown in detail in FIG. 7. At point 402, the CPU 62 inputs the data from the $O_2$ sensor and determines whether or not the signal level is "1" or "0", i.e., whether the air-fuel mixture is rich or not. If the answer is "no", then the signal from the $O_2$ sensor 42 is for a lean air-fuel mixture. In this case, the program proceeds to point 404 where it is determined whether or not a flag $fO_2$ is 0. This flag $fO_2$ is reset (0) when the signal from the $O_2$ sensor changes from "1" (rich) to "0" (lean). The flag $fO_2$ is set (1) when the signal from the $O_2$ sensor changes from "0" (lean) to "1" (rich). A "no" answer at point 404 means that the $O_2$ sensor 42 has output, at the preceding cycle, a "1" signal, and that the air-fuel ratio has just changed from rich to lean, as realized at time $t_1$ in FIG. 5(*d*). At point 406, the flag $fO_2$ is reset (0). At point 408 a flag fS is set. This flag fS indicates whether or not the air-fuel ratio signal has changed from "1" to "0" or "0" to "1". That is, flag fS is set (1) at every skip control, and is reset (0) during the normal feedback control, as shown by lines $l_0$, $l_1$, and $l_2$ in FIG. 5(*d*). At point 410, a feedback correction factor FAF is stored in an area of the RAM 68, $f(A/F)_i$. This $f(A/F)_i$ value corresponds to a value of the feedback correction factor FAF at the time $t_1$ (FIG. 5(*d*)). At point 412, the feedback correction factor FAF is incremented by 10. This means that the feedback correction factor is abruptly increased, as shown by the curve $s_1$ at the time $t_1$, where the air-fuel ratio is changed from a rich condition (1) to a lean condition (0). Thus, as is well known to those skilled in the art, an effective feedback control of the air-fuel ratio to the target value $(A/F)_0$ is attained.

At a subsequent cycle for effecting this routine, if the air-fuel ratio is still lean, the answer at point 402 is "no". Since the flag $fO_2$ has reset at the preceding point 406, the answer at point 404 is now "yes". Thus the program proceeds to point 414, where the skip indicating flag fS is reset. At point 416, the feedback correction factor is incremented by 1. As a result, the feedback correction factor FAF begins a moderate increase, as shown by the line $l_1$ in FIG. 5(*d*). Note: the number 10 shown at point 412 and the number 1 shown at point 416 are only examples illustrating that the former number at the skip point (time $t_1$) is larger than the latter number. There is no particular significance attached to the actual value of these numbers.

Figure 8:
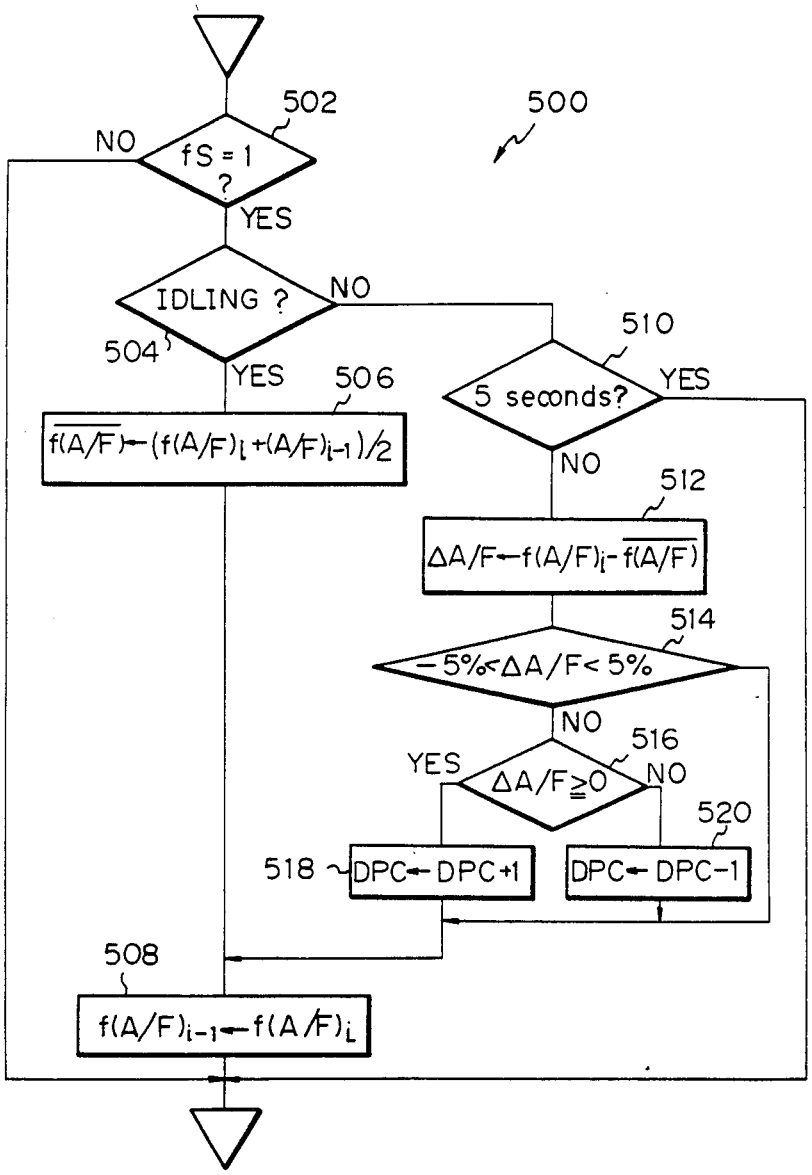
FIG. 8 is a flow chart showing details of the routine for calculating deviation of the air-fuel ratio at a transient state of the engine.

As a result of the increase in the feedback correction factor, as shown by the line $l_1$ in FIG. 5(*d*), the air-fuel ratio becomes smaller than the target value $(A/F)_0$, and the $O_2$ sensor signal changes from "0" to "1". Thus, the answer at point 402 of FIG. 8 is now "yes". The program then proceeds to point 418, where it is determined whether or not the flag $fO_2$ is set. At the moment when the $O_2$ sensor signal changes from "0" to "1", the flag $fO_2$ is reset (0), so that the answer at point 418 is "no". The program then proceeds to point 420, where the flag $fO_2$ is set (1), to point 422 where the skip indicating flag fS is set (1), and to point 424 where the value of the feedback correction factor FAF is stored in the area $f(A/F)_i$ of the RAM 68. At point 424, the feedback correction factor FAF is decremented by 10. That is, the feedback correction factor FAF is abruptly decreased, as shown by curve $s_2$ at the time $t_2$. Because of this "skip" control of the feedback correction factor FAF, the air-fuel ratio is quickly controlled to the target value (A/F).

At the subsequent cycle for effecting the routine in FIG. 7, if the air-fuel ratio is still rich, the answer at point 418 is "yes". That is, since the flag $fO_2$ is set (1) at point 420 during the preceding cycle, the result of the discrimination at point 418 is "yes", so that the program proceeds to point 426, where the skip indicating flag fS is reset (0). At point 428, the feedback correction factor is decremented by 1, and the feedback correction factor FAF begins to moderately decrease, as shown by the line $l_2$ in FIG. 5(*d*). Note: the number 1 is only an example and is determined so that the feedback correction factor is moderately decreased, as shown by the line $l_2$ in FIG. 5(*d*).

FIG. 8 is a detailed flow chart of the routine in block 500 shown in FIG. 6. This routine is for detecting any air-fuel ratio deviation or offset occurring when the engine condition changes from stable running to a transient condition, i.e., at acceleration. At point 502 it is determined whether or not the flag fS is set. When the answer is "no" at point 502, then it is not a time $t_0$, $t_1$, or $t_2$ wherein the skip control of the feedback correction factor, as shown by line $s_0$, $s_1$, or $s_2$ in FIG. 5(*d*), is just effected. The program then bypasses the routine shown in FIG. 8.

If the answer is "yes" at point 502, this signifies that it is just at the time, e.g., $t_0$, $t_1$, or $t_2$, wherein the skip control of the air-fuel ratio, as shown by the line $s_0$, $s_1$ or $s_2$ in FIG. 5(*d*), occurs. The program then proceeds to point 504, where it is determined whether or not the engine is in an idling condition. Under an idling condition, the air-fuel ratio is relatively stable. Thus, idling is considered a stable condition wherein the air-fuel ratio is effectively controlled to the target value $(A/F)_0$. An average value $\overline{f(A/F)}$ of the feedback correction factor FAF during idling may be used as a reference value of the air-fuel ratio, whether or not offset of the air-fuel ratio has occurred during the engine transient condition including acceleration. In point 504, the CPU 62 selects the analog multiplexer 54 so that the signal from the throttle sensor 51 is input to the A/D converter 56 for converting the analog signal from the throttle sensor 51 into a digital signal indicating the opening of the throttle valve 14. The CPU 62 then compares the detected data with the preset data corresponding to the throttle opening for idling.

A "yes" answer at point 504 means that the engine is in an idling condition, and allows the program to proceed to point 506. At point 506, a value of a feedback correction factor FAF at this skip cycle stored in the area $f(A/F)_i$ of the RAM 68 (see point 410 or 424 of FIG. 8) and a value of a feedback correction factor FAF at the preceding skip cycle stored in the area $f(A/F)_{i-1}$ of the RAM 68 (see point 508) are averaged. The average value is stored in an area $\overline{f(A/F)}$ of the RAM 68. This value $\overline{f(A/F)}$ is taken as the mean value of the feedback correction factor FAF during the idling or stable condition (FIG. 5(*d*)).

At point 508, the data in the RAM area $f(A/F)_i$ is moved to the RAM area $f(A/F)_{i-1}$, and is taken as the value of the feedback correction factor at the preceding skip cycle during the following skip cycle (see point 506).

When the engine enters into an acceleration condition from the idling condition at the time $t_{acc}$ in FIG. 5, the throttle opening is correspondingly increased, as shown in (a). Therefore, the answer at point 504 is now "no". The program then proceeds to point 510, where it is determined whether or not a predetermined short time, for example, 5 sec, has lapsed from the end of the idling condition. A "no" answer at point 510 means that the engine is under acceleration. The program then proceeds to point 512, where a value of the feedback correction factor FAF obtained at this skip cycle, which occurs at time $t_4$ in FIG. 5 and is stored in the RAM area $f(A/F)_i$, is subtracted from the mean value of the feedback correction factor FAF obtained during the idling condition and stored in the RAM area $\overline{f(A/F)}$. The result of the calculation is stored in the RAM area $\Delta A/F$. Therefore, assuming that a deviation of the air-fuel ratio to a lean side from the target value $(A/F)_0$ occurs at acceleration, as shown by the curve X in FIG. 5(*b*). In this case, the feedback correction factor begins to increase, as shown by the line $l_3$, at the time $t_3$ wherein the $O_2$ sensor signal changes from "1" (rich) to "0" (lean). As a result of the increase in the feedback correction factor FAF, the $O_2$ sensor signal changes from "0" (lean) to "1" (rich) at time $t_4$. This value of the feedback correction factor FAF at the time $t_4$ is stored in the RAM area $f(A/F)_i$ at point 512. An average value of the feedback correction factor at the two skip points preceding the skip at $t_4$ is stored in the RAM area $\overline{f(A/F)}$ as an average air-fuel ratio during the stable running condition. Thus the value $\Delta A/F$ calculated at point 512 is considered as to be an offset in the air-fuel ratio caused by a change in the engine operation from a stable running condition to a transient state. At point 514, it is determined whether or not $\Delta A/F$ is within a predetermined low value range, for example, ±5%. A "yes" at point 514 means that offset has not occurred, and the program proceeds to point 508, explained previously.

A "no" at point 514 means that some offset in the air-fuel ratio from the target value is occurring due to the acceleration. In this case the program proceeds to point 516, where it is determined whether or not $\Delta A/F$ is larger than zero. A "yes" at point 516 means that an offset of the air-fuel ratio toward the lean side, i.e., a "lean spike", has occurred. Thus, at the following point 518, the value of the acceleration counter DPC is incremented. A "no" at point 516 means that an offset of the air-fuel ratio toward the rich side, i.e., a "rich spike", has occurred. Thus, the program proceeds to point 520, where the acceleration counter DPC is decremented.

Figure 9:
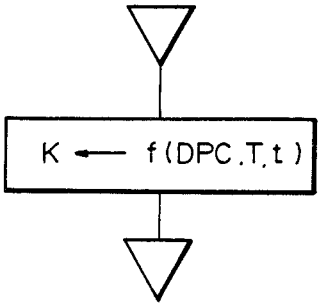
FIG. 9 shows a routine for calculating an acceleration correction factor.

FIG. 9 is a concept of the routine 600, shown in FIG. 6, for calculating the acceleration correction factor. In this routine, a correction factor K is calculated from the value of the acceleration counter DPC obtained at point 518 or 520, together with the temperature T of the cooling water sensed by the water temperature sensor 50 and the time t lapsed. As a result, a characteristic of the correction factor is obtained which is rapidly increased to the initial maximum value, and then is decreased in accordance with the time lapsed, as shown in FIG. 5(*f*). The initial maximum value is mainly determined by the value of the acceleration counter DPC which can have, after the attainment of learning control shown in FIG. 8, a value for maintaining a substantially unchanged air-fuel ratio, as shown in line Y in FIG. 5(*b*), even if the engine condition changes from stable running to acceleration. The area of the RAM 68 in which the learned value of the acceleration counter DPC is stored may be constituted as a nonvolatile type RAM, allowing the engine to maintain the stabilized acceleration condition newly stated after the engine is stopped.

Figure 10:
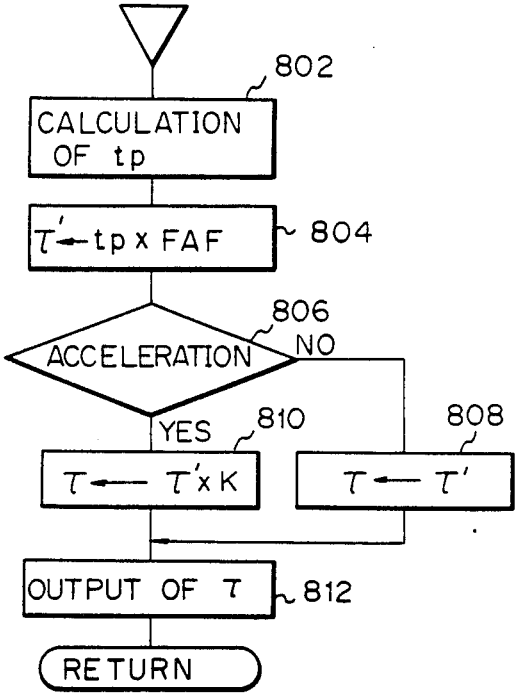
FIG. 10 is a flow chart of an interruption routine for calculating the fuel amount to be injected.

FIG. 10 is flow chart of a routine for effecting fuel injection, which is an interruption routine effected at every one rotation of the engine. The crank angle sensor 44 issues a signal indicating every one rotation of the engine. When this signal is issued, the CPU 62 starts the interruption routine described in FIG. 10.

At point 802 in FIG. 10, a basic injected fuel amount $t_p$ is calculated. The details of this routine are shown in FIG. 11.

Figure 11:
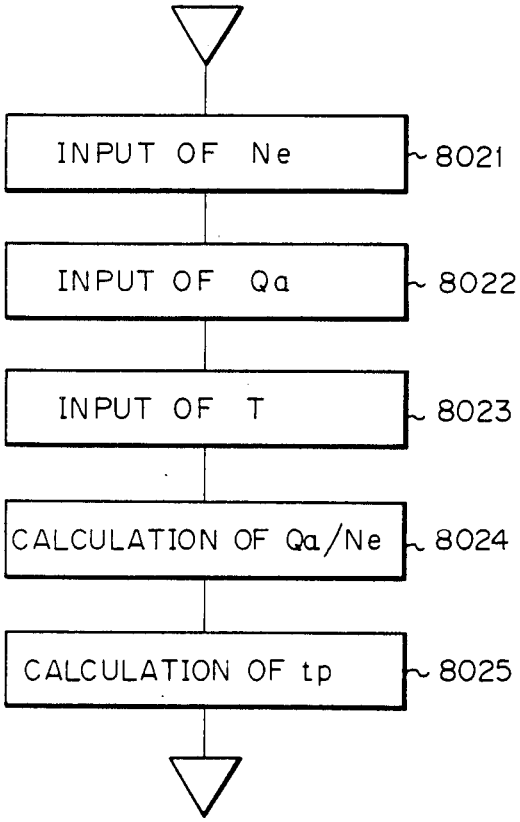
FIG. 11 is a flow chart of a routine for calculating a basic fuel amount to be injected.

At point 8021 in FIG. 11, the CPU 62 inputs the data of the rotational speed of the engine Ne from the input port 59 connected to the Ne forming circuit 58. At point 8022, the CPU 62 selects the analog multiplexer 54 so that the signal from the air-flow meter 12 is input to the A/D converter 56. The A/D converter converts the analog signal from the air-flow meter 12 indicating an intake air amount Qa to a digital signal which is input to the internal resistor in the CPU 62. At point 8023, the CPU 62 selects the analog multiplexer 54 so that the signal from the engine water temperature sensor 50 is input to the A/D converter 56. The A/D converter 56 converts the analog signal indicating the temperature of the engine cooling water T into a digital signal which is input to the CPU 62. At point 8024 the CPU 62 calculates the intake air amount Qa divided by the rotational speed of the engine Ne. The program then proceeds to point 8025, where a basic amount of fuel to be injected $t_p$ is calculated through the values Qa/Ne and T. The obtained data of the basic injected fuel amount $t_p$ is stored in a predetermined area of the RAM 68.

To return to FIG. 10, the program then proceeds from point 802 to point 804 to calculate $\tau'$, which is a product of $t_p$ and FAF. At point 806, it is determined whether or not the engine is under acceleration. A "no" at point 806 means that the engine is in a stable running condition, and the program then proceeds to point 808, where the value $\tau'$ is moved to the RAM area $\tau$. When the engine is under acceleration, the program proceeds to point 810, where the value $\tau'$ multiplied by the acceleration correction factor K is moved to the RAM area $\tau$. At point 812, the CPU 62 sets the down counter 77 to this value $\tau$. When the down counter 77 is set, it starts to count down after receiving a trigger signal issued from the bus 72, which also triggers the bistable circuit 78, so that the fuel injector 16 starts the fuel injection into the intake pipe 17. When the countdown is completed, the down counter 77 issues a pulse to reset the bistable circuit 78, so that the fuel injector 16 is closed. As a result, the calculated amount of fuel, corresponding to the value $\tau$ is injected into the intake pipe 17, and the engine maintains the target air-fuel ratio value irrespective of whether the engine condition includes acceleration.

Figure 12A:
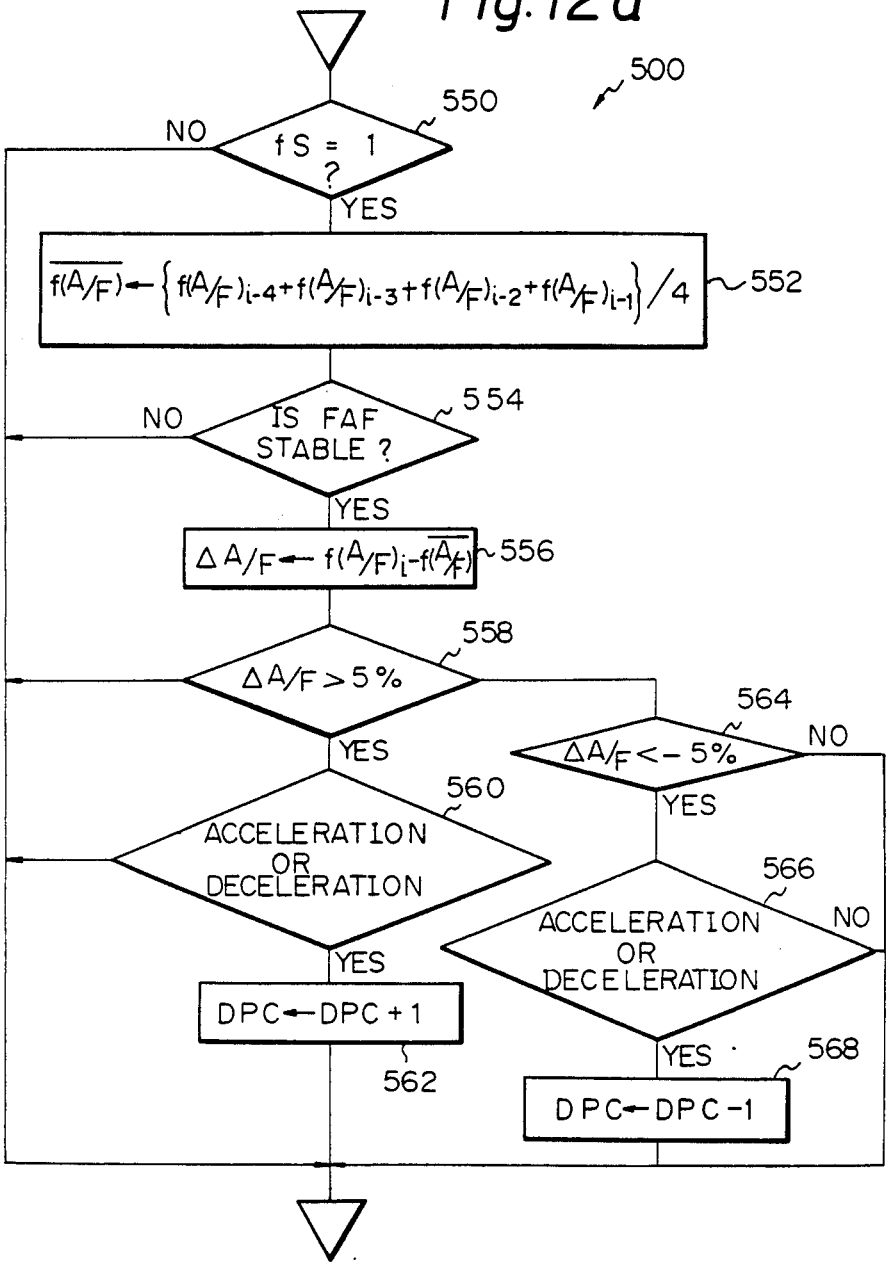
FIG. 12*a* is a flow chart showing another embodiment used for calculating the deviation of the air-fuel ratio at the transient state.
Figure 12B:
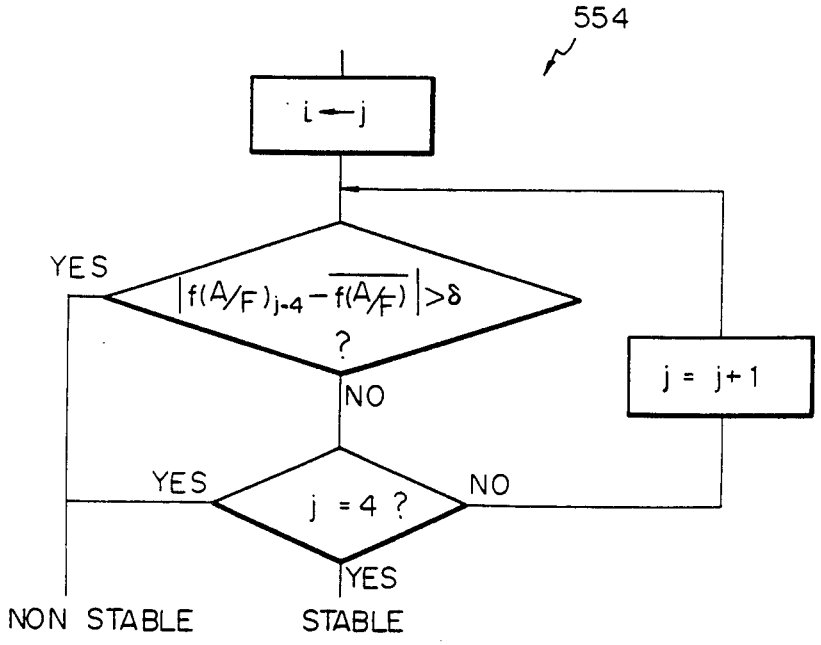
FIG. 12*b* is a continuation of FIG. 12*a;*

FIGS. 12*a* and 12*b* are a flow chart showing another embodiment used for effecting the routine 500, shown in FIG. 6, for detecting air-fuel ratio deviation when the engine changes from a stable running condition to a transient condition, including acceleraton or deceleration. At point 550, it is determined whether or not the skip indicating flag fS is reset. If the answer is "no", the detecting routine is bypassed. When the skip occurs in this cycle ("yes"), the program proceeds to point 552 where the values of the feedback correction factor FAF at the preceding four skip points, $f(A/F)_{i-4}$, $f(A/F)_{i-3}$, $f(A/F)_{i-2}$, and $f(A/F)_{i-2}$, are averaged. The obtained value is moved to the RAM area $\overline{f(A/F)}$. At point 554, it is determined whether or not the engine is in a stable running condition. This discrimination is carried out as shown in FIG. 12*b*, and is effected by comparing the value of $f(A/F)_{i-4}$, $f(A/F)_{i-3}$, $f(A/F)_{i-2}$, or $f(A/F)_{i-2}$ with the average value $\overline{f(A/F)}$ and determining whether or not the difference is within a low value $\delta$. If any one of these differences is larger than $\delta$, the air-fuel ratio is taken as non-stable, so that the program bypasses the routines below point 554 in FIG. 12. If the answer is "yes", i.e., the engine is in a stable running condition, the program proceeds to point 556 in FIG. 12 where the value of the feedback correction factor FAF at this skip point and stored in the RAM area $\overline{f(A/F)}_i$ is subtracted from the mean value in the RAM area f(A/F) obtained at point 552. The difference is stored in the RAM area ΔA/F. At point 558 it is determined whether or not the value ΔA/F is larger than 5%. If the answer is "yes", the air-fuel ratio is considered to be offset with respect to the target value $(A/F)_0$. In this case, the program proceeds to point 560, where it is determined whether or not the engine is under acceleration or deceleration. A "yes" answer means that an air-fuel ratio deviation larger than 5% has originated from a "lean spike" during acceleration or deceleration. At the following point 562, the value of the counter DPC is incremented, as described with reference to FIG. 9 at point 518.

A "no" answer at point 558 causes the program to proceed to point 564, where it is determined whether or not the air-fuel ratio deviation detected at point 556 is smaller than 5%. A "yes" answer causes the program to proceed to point 566, where it is determined whether or not the engine is under acceleration. If the answer at point 566 is "yes", the air-fuel ratio deviation larger than 5% is considered to have originated from a "rich spike" during the transient state of the engine. Therefore, at the following point 568, the value of the counter DPC is decremented, as described with reference to point 520 in FIG. 9 in the previous embodiment.

Figure 13:
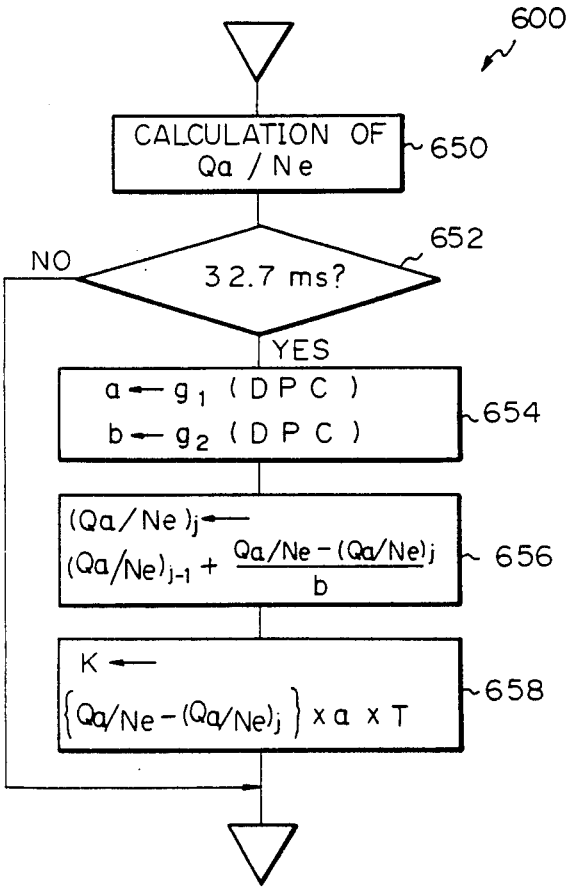
FIG. 13 is a flow chart showing another embodiment for calculating the acceleration correction factor K.

FIG. 13 is a flow chart showing the details of the routine 600, shown in FIG. 6, used for calculating an acceleration correction factor K. At point 650, an amount of intake air per one rotation of the engine, Qa/Ne, is calculated. At a point 652, it is determined whether or not a predetermined short time has lapsed after the preceding acceleration correction was effected. In this example, the time interval is 32.7 ms. The acceleration correction routine does not enter into the calculation before the lapse of the predetermined time interval.

When the time interval of 32.7 ms has lapsed, the answer at point 652 becomes "yes", and the program proceeds to point 654 where an acceleration correction coefficient a and a rounding or loosening coefficient b are taken as a function of the value of the air-fuel ratio correcting counter DPC. The ROM 70 is provided with maps of the acceleration correction coefficient a and the rounding coefficient b with respect to various values of the DPC. The CPU calculates the values a and b at one value of the DPC, calculated at point 518 or 520 of FIG. 9, from the maps. That is, the acceleration correction factor a and the rounding coefficient b are calculated in accordance with the deviation of the air-fuel ratio from the target value $(A/F)_0$ at acceleration.

At point 656, the value of Qa/Ne calculated at point 650 is rounded or idled by the following equation.

$$(Qa/Ne)_j=(Qa/Ne)_{j-1}+\{Qa/Ne-(Qa/Ne)_{j-1}\}/b \quad (1)$$

wherein $(Qa/Ne)_{j-1}$ is $(Qa/Ne)_j$ which is obtained when the program effects the routine 32.7 ms previously.

In the above-mentioned equation, (Qa/Ne) is a value of the ratio of the intake air amount to the rotation speed during the preceding cycle, whereas $Qa/Ne-(Qa/Ne)_{j-1}$ is an actual increase in the ratio at this cycle from the preceding cycle. Since this actual increase is divided by b, (Qa/Ne) has a value smaller than the value actually attained by Qa/Ne. Thus, a loosened change of $(Qa/Ne)_j$ is obtained.

At point 658, following point 606, an acceleration correction factor K is calculated by the following equation.

$$K=\{Qa/Ne-(Qa/Ne)_j\}\times a\times T \quad (2)$$

wherein T is a temperature of the engine cooling water sensed by the engine cooling water temperature sensor 50.

FIG. 14 illustrates how the throttle opening TH, Qa/Ne, $(Qa/Ne)_j$, K, and fuel injection time $\tau$ change after the start of the acceleration. The throttle opening TH is abruptly increased at the start of the acceleration, as shown by (a). Qa/Ne attains a curve which corresponds to the change in the throttle opening, as shown by (b). The rate of the change in $(Qa/Ne)_j$, which is determined by equation (1), is loosened when compared with the change in Qa/Ne, as shown by (c). An acceleration correction factor K, determined by equation (2), changes as shown by FIG. 14(*d*). The factor K abruptly attains the maximum value and slowly decreases in accordance with the lapse of time. The time period $\tau$ for opening the fuel injector 16, which corresponds to the amount of fuel to be injected, is changed as shown by (e).

When the engine is decelerated by closing the throttle valve 14, the throttle opening TH rapidly decreases, as shown in FIG. 15(*a*). Thus, a value of Qa/Ne correspondingly decreases, as shown by FIG. 15(*b*) The value $(Q/N)_j$ slowly decreases in accordance with equation (1), as shown by FIG. 15(*c*). The change of the correction factor K is decreased in a waveform, as shown by FIG. 15(*d*). Thus, the time period $\tau$ for opening the fuel injector 16 changes as shown in FIG. 15(*e*).

Figure 16:
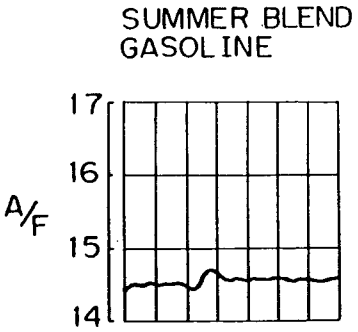
FIGS. 16(A) and 16(B) illustrate an effect of the learning control of the present invention when the blend of gasoline is changed.
Figure 16:
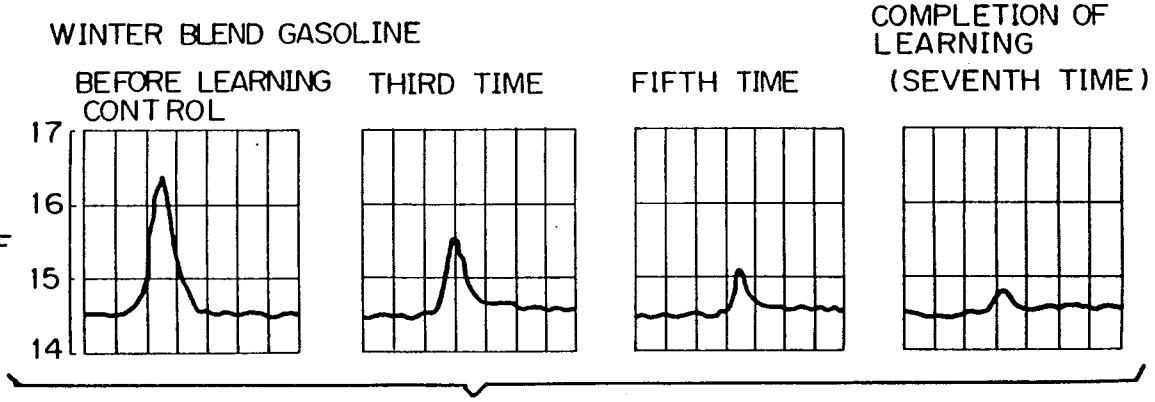

In FIG. 16, the effect of the learning control according to the present invention is illustrated. A change of the air-fuel ratio with regard to the time lapse during which the engine is under acceleration is shown when a summer blend gasoline (temperature for distillating 10% of gasoline, 47° C., Reid vapor pressure 0.72 kg/cm$^2$) is used is shown in FIG. 16(A). In this case, the air-fuel ratio w is substantially maintained without being changed.

When a winter blend of gasoline (temperature for distillating 10% of gasoline, 54° C.: Reid vapor pressure 0.6 kg/cm$^2$) having a lower volatility is used, a certain change in the air-fuel ratio, i.e., a "lean spike", occurs at acceleration before the learning control of the present invention is effected. However, a seven times learning control in the system realized by the software shown in FIG. 12 permits the attainment of an air-fuel ratio change characteristic which is substantially the same as that obtained when using gasoline (A), as shown in FIG. 16(B). If the correction coefficient is enlarged, a shorter learning is sufficient to obtain the desired effect. The effects shown in FIG. 16 are obtained under the conditions wherein the engine rotational speed is 1000 rpm, the coolant water temperature is 30° C., and the acceleration condition was that wherein the intake vacuum is changed from −400 mmHg to −100 mmHg.

Figure 17:
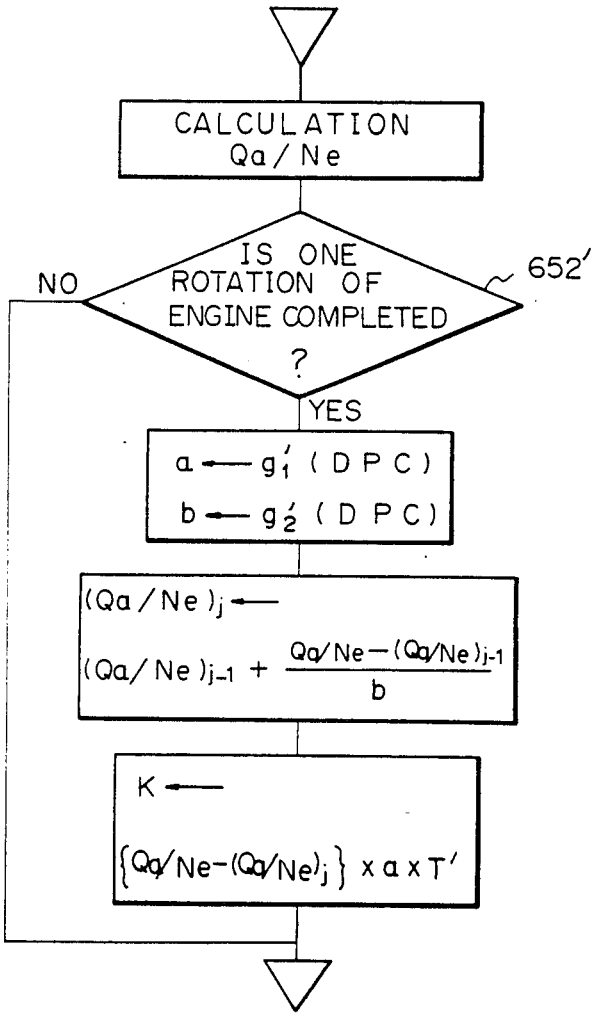
FIG. 17 shows a modification of the embodiment used for calculating the acceleration correction factor shown in FIG. 13.

FIG. 17 is a modification of FIG. 13. The embodiment shown in FIG. 17 differs from the embodiment of FIG. 13 in that the determination at point 652' is effected by each one rotation of the engine, instead of detecting the time interval as at point 652 in FIG. 13.

That is, the calculation of Qa/Ne is effected in synchronism with the engine rotation.

A calculation of (Qa/Ne) synchronous with the engine rotation permits the number of engine combustion cycles under the fuel control by the correction factor K, regardless of the engine rotation number, to be maintained at substantially the same figure during the same acceleration condition. As a result, a constant air-fuel ratio during the transient state may be maintained at all operational conditions of the engine.

In the embodiments shown in FIGS. 13 and 17, the calculation of the acceleration correction coefficient is determined by Qa/Ne and its loosened amount. However, other values such as the intake pipe vacuum, throttle opening, and their corresponding loosened amounts, may be used in place of Qa/Ne and its loosened amount, to obtain the correction factor.

What is claimed:

1. A system for controlling the air-fuel ratio to a predetermined value in an internal combustion engine comprising:

first sensor means for sensing an actual air-fuel ratio and issuing a signal having two levels, one level corresponding to an air fuel ratio larger than the predetermined value, the other level corresponding to an air-fuel ratio smaller than the predetermined level;

second sensor means for detecting a change in engine conditions from a steady state to a transient state;

processing means for performing the following functions: (a) calculating a basic amount of fuel to be supplied to the engine, which amount is determined in accordance with engine operating conditions, (b) in response the signal from said first sensor means, increasing a first correcting factor for correcting the basic fuel amount when said signal has one level, and decreasing the first factor when said signal has another level, in order to maintain the actual fuel ratio to the predetermined value, (c) calculating the difference in value between the value of the first correcting factor during the preceding steady state and the value of the first correcting factor when a change to the transient state is sensed by the second sensor means, (d) calculating a second correcting factor for correcting the basic fuel amount based on the value of said difference and (e) calculating a final fuel amount from the basic fuel amount and the first correcting factor but not the second correcting factor during the steady state and from the basic fuel amount and at least the second correcting factor during the transient state, said second correcting being calculated to eliminate said difference during the transient state; and means for providing a supply of fuel to the engine so that the calculated final fuel amount is supplied to the engine.

2. A system according to claim 1, wherein said difference calculating function (c) calculates a mean value of the first correcting factor during the steady state condition, calculates a value of the first correcting factor when the state of the engine changes to the transient state, and calculates the difference between said two values.

3. A system according to claim 2, wherein the calculation of the value of the first correcting factor when the state of the engine changes to the transient state is effected after a predetermined time has lapsed from the change of the engine condition to the transient state.

* * * * *